US007855691B2

(12) United States Patent
Yonak et al.

(10) Patent No.: US 7,855,691 B2
(45) Date of Patent: Dec. 21, 2010

(54) AUTOMOTIVE RADAR USING A METAMATERIAL LENS

(75) Inventors: Serdar H. Yonak, Ann Arbor, MI (US); Alexandros Margomenos, Ann Arbor, MI (US); Koji Shiozaki, Ann Arbor, MI (US); Paul D. Schmalenberg, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 310 days.

(21) Appl. No.: 12/187,429

(22) Filed: Aug. 7, 2008

(65) Prior Publication Data

US 2010/0033389 A1 Feb. 11, 2010

(51) Int. Cl.
*H01Q 19/10* (2006.01)
*H01Q 15/02* (2006.01)

(52) U.S. Cl. ..... 343/755; 343/909

(58) Field of Classification Search ..... 343/753–755, 343/711, 909

See application file for complete search history.

(56) References Cited

U.S. PATENT DOCUMENTS 6,342,865 B1 1/2002 Chandler et al.
7,538,946 B2 * 5/2009 Smith et al. ..... 359/569
7,570,432 B1 * 8/2009 Yonak ..... 359/652
2001/0038325 A1 * 11/2001 Smith et al. ..... 333/202
2006/0178142 A1 8/2006 Lovberg et al.

FOREIGN PATENT DOCUMENTS

GB 2234858 2/1991
JP 03120488 5/1991

* cited by examiner

*Primary Examiner*—Shih-Chao Chen
(74) *Attorney, Agent, or Firm*—Gifford, Krass, Sprinkle, Anderson & Citkowski, P.C.

(57) ABSTRACT

An example apparatus comprises an electromagnetic source, such as an antenna, a metamaterial lens, and a reflector. The antenna is located proximate the metamaterial lens, for example supported by the metamaterial lens, and the antenna is operable to generate radiation when the antenna is energized. The reflector is positioned so as to reflect the radiation through the metamaterial lens. The reflector may have a generally concave reflective surface, for example having a parabolic or spherical cross-section. The metamaterial lens may have an area similar to that of the aperture of the reflector. In some examples, the antenna is located proximate a focal point of the reflector, so that a generally parallel beam is obtained after reflection from the reflector.

23 Claims, 7 Drawing Sheets

AUTOMOTIVE RADAR USING A METAMATERIAL LENS

FIELD OF THE INVENTION

The invention relates to electromagnetic devices, in particular to radar apparatus including a metamaterial lens.

BACKGROUND OF THE INVENTION

Radar apparatus find various applications, such as automotive applications including parking assistance and automatic cruise controls. Control of the radar beam allows improved functionality of the apparatus.

Metamaterials are useful for radar applications. An example metamaterial is a composite material having an artificial structure that can be tailored to obtain desired electromagnetic properties. A metamaterial may comprise a repeated unit cell structure. An example unit cell comprises an electrically conducting pattern formed on an electrically non-conducting (dielectric) substrate. The physics of metamaterial are described, for example, in WO2006/023195 to Smith et al.

The electromagnetic response of a metamaterial may be controlled using different parameters associated with a unit cell. For example, parameters may include unit cell dimensions, shape and size of conducting patterns therein, and the like. Hence, a metamaterial can be manufactured having a desired electromagnetic property at a particular operating frequency.

SUMMARY OF THE INVENTION

An example apparatus comprises an electromagnetic source, such as an antenna, a metamaterial lens, and a reflector. The antenna is located proximate the metamaterial lens, for example supported by the metamaterial lens, and the antenna is operable to generate radiation when the antenna is energized. The reflector is positioned so as to reflect the radiation through the metamaterial lens. The reflector may have a generally concave reflective surface, for example having a parabolic or spherical cross-section. The reflector may be generally dish-shaped, and may have a circular or oval aperture. The metamaterial lens may have an area similar to that of the aperture of the reflector. In some examples, the antenna is located proximate a focal point of the reflector, so that a generally parallel beam is obtained after reflection from the reflector.

In some examples, a lens assembly comprises a metamaterial lens and an antenna integrated together into a unitary structure, and may further comprise an electronic circuit in electrical communication with the antenna. For example, the antenna may be supported by a dielectric substrate assembly, and the same dielectric substrate assembly may also support resonant circuits that are components of the metamaterial lens. In some examples, an antenna (or antenna feed) may located on, substantially adjacent to, or be otherwise supported by a dielectric substrate, the dielectric substrate also providing a component of the metamaterial lens. A metamaterial lens may comprise one or more dielectric substrates, for example using a multilayer assembly of printed circuit boards. In some cases, a dielectric substrate used to form the metamaterial lens may further support an electronic circuit associated with the antenna, such as a radio-frequency (RF) circuit used for transmission and/or detection of radiation.

An example apparatus comprises a metamaterial lens, a radar antenna, and a reflector. The metamaterial lens comprises a plurality of resonant circuits disposed on one or more dielectric substrates, and a dielectric substrate used to form the metamaterial lens can also be used to support the antenna. A dielectric substrate used to form the metamaterial lens can also used to support an electronic circuit associated with the antenna. The same dielectric substrate can be used to support the electronic circuit and the antenna, or different substrates used for the antenna and associated electronic circuit. The antenna may be disposed on the dielectric substrate, located adjacent the dielectric substrate, or otherwise supported by the dielectric substrate. The reflector may be positioned so as to reflect radiation generated by the antenna through the metamaterial lens.

The reflector may be a converging reflector having a central optical axis, and the antenna may be located (at least approximately) at a point along the optic axis. In some examples, the antenna is located at, or close to, the focus of the reflector. For example, the reflector may have a generally concave reflective surface, and may be parabolic reflector. In some examples, the transmitted beam diverges as it propagates away from a first face of a metamaterial lens, and is converged to a generally parallel beam after reflection. The generally parallel beam then propagates towards the first face of the metamaterial lens. The beam passes through the metamaterial lens and emerges from a second face of the metamaterial lens. If the metamaterial lens has a gradient index, the beam is deviated by an angle. By varying the index gradient (for example, electronically, magnetically, using a radiation field, or by mechanical rotation), beam steering may be obtained by varying the deviation angle.

The metamaterial lens may comprise a plurality of conducting patterns disposed on a dielectric substrate, the dielectric substrate further supporting a radio-frequency electronic circuit associated with the antenna.

A further example apparatus comprises a metamaterial lens, including a plurality of conducting elements disposed on a dielectric substrate, an antenna supported by the dielectric substrate, and a reflector, the reflector having a generally concave reflecting surface. The reflector may be positioned so as to reflect radiation from generated by the antenna through the metamaterial lens. The metamaterial lens may be a passive metamaterial lens, or a dynamic metamaterial lens. In the latter case, the lens properties may be dynamically adjusted, for example using an electrical control signal. For example, in an apparatus comprising an active metamaterial, the direction, divergence, convergence, or other parameter of a produced beam of radiation may be controllable using an electronic control signal applied to the active metamaterial.

Example apparatus further include a unitary device comprising a metamaterial lens, and antenna, and (optionally) further comprising an electronic circuit associated with the antenna. For example, a common dielectric substrate can be used to support conducting elements associated with the metamaterial lens, the antenna, and the electronic circuit. For example, the dielectric substrate may be provided by a printed circuit board (PCB), with the metamaterial lens, antenna, and (optionally) the electronic circuit integrated onto a single PCB. In some examples, multiple dielectric substrates may be used, for example using one or more single or double sided PCBs to provide the metamaterial lens (or component thereof), antenna feed (in some cases, the antenna itself), and the associated electronic circuit. The unitary device can be used in cooperation with a reflector to provide a compact radar source.

DETAILED DESCRIPTION OF THE PREFERRED EMBODIMENTS

Figure 1:
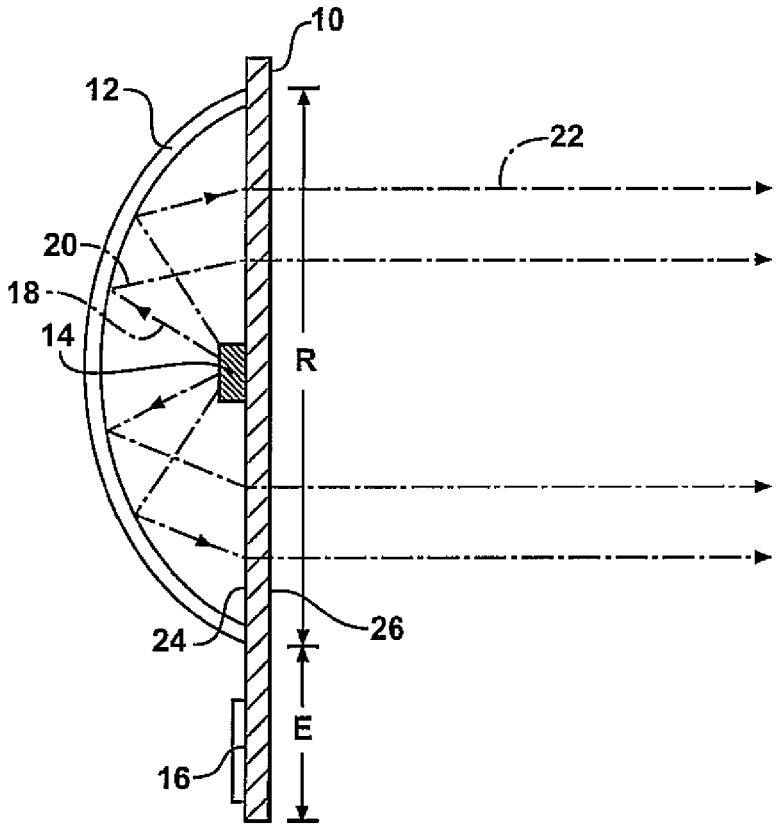
FIG. 1 shows a cross-sectional view of an apparatus comprising a reflector, metamaterial lens, and an antenna.

Examples of the present invention include compact radar apparatus using a metamaterial lens and a reflector. In an example apparatus, a lens assembly comprises a metamaterial lens integrated with an antenna, and the antenna and components of the metamaterial lens may be both supported by the same substrate, for example a dielectric layer such as may be part of a printed circuit board. The lens assembly may have a single substrate (such as a single circuit board), or may have multilayer substrate, for example comprising two or more spaced apart circuit boards. The substrate may also support RF electronics, for example silicon-germanium high speed electronics or other electronic circuitry.

Example apparatus may further comprise a reflector, such as a concave reflector, in particular examples a parabolic reflector. The antenna is operable to provide a transmitted radar beam, which radiates away from a first face of the substrate and is incident on the reflector. The reflector directs the transmitted beam through the metamaterial lens. The metamaterial lens may operate as a beam steering device and/or may provide dynamically adjustable focusing of the transmitted beam.

The integration of an antenna and a material lens into a unitary structure provides cost savings and also allows a more compact radar transmitter to be developed. Further, the combination of a reflector and a metamaterial lens allows a very compact radar source to be developed. The compact source so provided allows manipulation of the transmitted beam, including dynamically variable focus and beam steering, for example using a tunable metamaterial lens. RF electronics may be supported by the same substrate, and be in electrical communication with a patch antenna feed.

Embodiments of the present invention include a metamaterial lens assembly (or "lens assembly) comprising a metamaterial lens, and further comprising an antenna and/or components associated with antenna. For example, an example lens assembly comprises a metamaterial lens and RF front end circuitry. For example, the lens assembly may comprise a substrate used to support both resonator circuits that are components of a metamaterial lens, and also to support RF circuitry. In some examples, a multilayer circuit board is used to support both the metamaterial lens and at least some components of the RF front end. An antenna, such as a patch antenna, may be supported by a lens assembly, and in some examples by the substrate used as a component of the metamaterial lens and to support an RF front end circuit. A lens assembly may include an antenna feed, either towards the center of the lens or at an edge thereof and may further include a voltage control oscillator, RF circuit, and down conversion circuit. The metamaterial may cover a portion of the lens assembly, part of the remaining portion being used to provide the RF electronics. Power electronics, signal processing, and communications electronics may be provided by a separate circuit board.

A metamaterial lens assembly according to an example of the present invention includes a metamaterial in the form of an artificially structured composite material including a plurality of resonant circuits. Each resonant circuit may include an electrically conducting pattern.

In some examples, an active metamaterial is used, allowing lens properties to be adjusted, for example using an electrical control signal. At least one resonant circuit may include a tunable element, such as a varactor (e.g. a varactor diode), or a material having an adjustable permittivity. Tunable elements allow the electromagnetic response of the resonant circuit to be modified.

An example metamaterial may comprise a repeated unit cell structure, each unit cell comprising an electrically conducting pattern supported by a dielectric substrate. An example electrically conducting pattern may be an electrically-coupled LC resonator, or other electrically conducting pattern including a capacitive gap between conducting regions. The tunable material may be located partially or wholly within, or proximate to, the capacitive gap.

The lens may comprise a passive metamaterial, for example comprising patterned conducting elements on a dielectric substrate. In other examples, the lens comprise an active metamaterial, for example a metamaterial further comprising tunable elements such as a varactor diode or other voltage control capacitor. Spatial variation of lens tuning allows gradient index lenses to be achieved. Dynamically tunable gradient index lenses can be useful in beam steering applications.

For radar applications, an operating frequency can be in the range of 10 gigahertz to 100 gigahertz, for example approximately 77 gigahertz.

The dielectric substrate may be a dielectric material such as a glass or plastic. In some examples, the substrate may be a liquid crystal polymer laminate, or other preferably low dielectric loss single or double clad circuit boards. Two or more such boards may be used in a multilayer substrate. For example, a pair of double clad circuit boards may be stacked to form a multilayer structure.

An example apparatus comprises a lens assembly, the lens assembly comprising a metamaterial lens integrated with a radar antenna. Resonant circuits (such as patterned conductors) of the metamaterial lens may be supported by a substrate, such as a dielectric substrate, and the same substrate may used to support the antenna, or an antenna feed. The metamaterial lens may comprise one or more layers of electrically conducting patterns, for example as a multi-layer printed circuit board (PCB). For example, electrically-coupled inductor-capacitor resonators (ELC resonators) may be formed on a dielectric substrate by any patterning techniques, including etching. Metal clad dielectric substrates may be patterned by conventional printed circuit board manufacturing techniques.

Examples of the present invention also include the use of a metamaterial lens and a reflector, configured so as to cooperatively provide a radar beam. In some examples, a lens assembly including a metamaterial lens includes (or is used to support) a radar source, for example an antenna such as a patch antenna. Transmitted radiation from the antenna is incident of the reflector, and is reflected back (as a reflected beam) through the lens to provide the output beam. The reflector may be a generally concave reflector, having a generally concave reflective surface. In some examples, a planar reflector may be used. Similarly, received radiation passes through the lens assembly onto the reflector, and is reflected onto a detector, which may be the same antenna used for transmission. Time gating may be used to control transmit and receive functionalities. Embodiments of the present invention include transmitters, receivers, and transceiver apparatus.

In examples of the present invention, a metamaterial lens is used as a support structure for an electromagnetic source, such as a radar antenna. For example, an antenna feed may be supported by the same substrate that is used to support some element of the lens, for example the conducting patterns used in the metamaterial lens. The substrate for the antenna feed and/or associated RF electronics may also be a parallel substrate in a multilayer structure.

An RF antenna and metamaterial lens have not previously been integrated into a single lens assembly. Such a lens assembly provides both economy of manufacture, and further allows highly efficient and compact radar apparatus to be constructed. A lens assembly formed as the combination of a metamaterial lens and an antenna may include one or more substrate layers, such as circuit boards, for example using conventional multilayer circuit board manufacturing techniques. In a particular example, a multi-layer substrate comprises a pair of spaced apart double layer circuit boards. A four layer structure, having four conducting layers of metal supported on each side of each dielectric substrate, may be etched or otherwise processed to provide regions of metamaterial, and further regions supporting an electronic circuit and/or antenna feed structures, In some examples, one or more substrate layers are used to support RF circuitry operable to drive the RF antenna.

An example apparatus according to an embodiment of the present invention comprises a metamaterial lens, an RF source, RF circuitry, and a reflector. The RF source and optionally the RF circuitry may be integrated with the metamaterial lens. The RF source, an antenna, is operable to generate a transmitted beam, which is incident on a reflecting face of the reflector. The beam is reflected back through the metamaterial lens, and may be modified by the metamaterial lens for example to improve beam properties, or obtain redirection of the beam.

Adjustment of the beam by the lens may be dynamically controllable, for example using an active metamaterial having electrically adjustable parameters, for example a metamaterial including tunable elements. In some examples of the present invention, the metamaterial lens and RF electronics are integrated into the same unitary structure. In some examples, the metamaterial lens and RF antenna are integrated into the same unitary structure. In some examples, the metamaterial lens and RF electronics are integrated into the same structure, along with the RF antenna.

FIG. 1 shows a cross section through an example apparatus, comprising metamaterial lens assembly 10, reflector 12, antenna 14, and RF electronics 16. The antenna 14 generates transmitted beam 18 which is incident on reflector 12 and reflected back (as reflected beam 20) through the lens assembly 10 to form the output beam 22. The lens assembly 10 includes a metamaterial lens in a region indicated by the double-headed arrow R. For example, the distance R may correspond to a diameter of a generally circular metamaterial lens provided by a region of the lens assembly 10. In this region, the lens assembly may comprise a metamaterial, for example comprising resonators supported by one or more dielectric substrates. Outside of this region, the lens assembly may be used to support other functionalities, in this example the RF electronics 16 within a region denoted by the arrow E. The reflector may be a conventional parabolic radar reflector, and this aspect is not discussed in detail as parabolic reflectors are well known in the radar arts.

In this example, the antenna is shown located closer to the reflector than the reflector focus, so that the reflected beam 20 entering the metamaterial is diverging. In other examples, the antenna may be located at the focus of the reflector, so that the reflected beam is substantially parallel (or may have a small divergence, such as less than 5 degrees) as it enters the metamaterial lens. In the example shown in FIG. 1, the metamaterial lens has an index profile that produces convergence of the reflected beam 20, so that the output beam 22 is substantially parallel.

In this example, the reflector is generally dish-shaped, and may be parabolic, and the edges of the reflector are in mechanical connection with the lens assembly 10. However it is not necessary that the reflector and lens assembly 10 are in physical contact. The reflector may be spaced apart from the lens assembly. The antenna is supported by the lens assembly, and the lens assembly has first and second faces (24 and 26, respectively). The antenna is located on the first face of the lens assembly, and is operable to generate transmitted radiation 18 that is directed away from lens assembly. The transmitted radiation 18 is incident on a reflecting face of the reflector, and the reflected beam 20 is directed back towards the first face of the lens assembly. The radiation passes through lens portion of the lens assembly, so that the output beam 22 emerges out of the second face of the lens assembly.

In some examples, the metamaterial lens may have an index profile that produces an angular deflection of the beam direction, for example an index gradient (e.g. a linear gradient). In some examples, the metamaterial lens may have an index profile that produces divergence or convergence of the output beam (relative to the reflected beam entering the metamaterial lens, after reflection). In some cases, an index profile may allow both beam steering and adjustable convergence and divergence. For example, the index profile of an active metamaterial may be adjusted using an electrical control signal.

Figure 2:
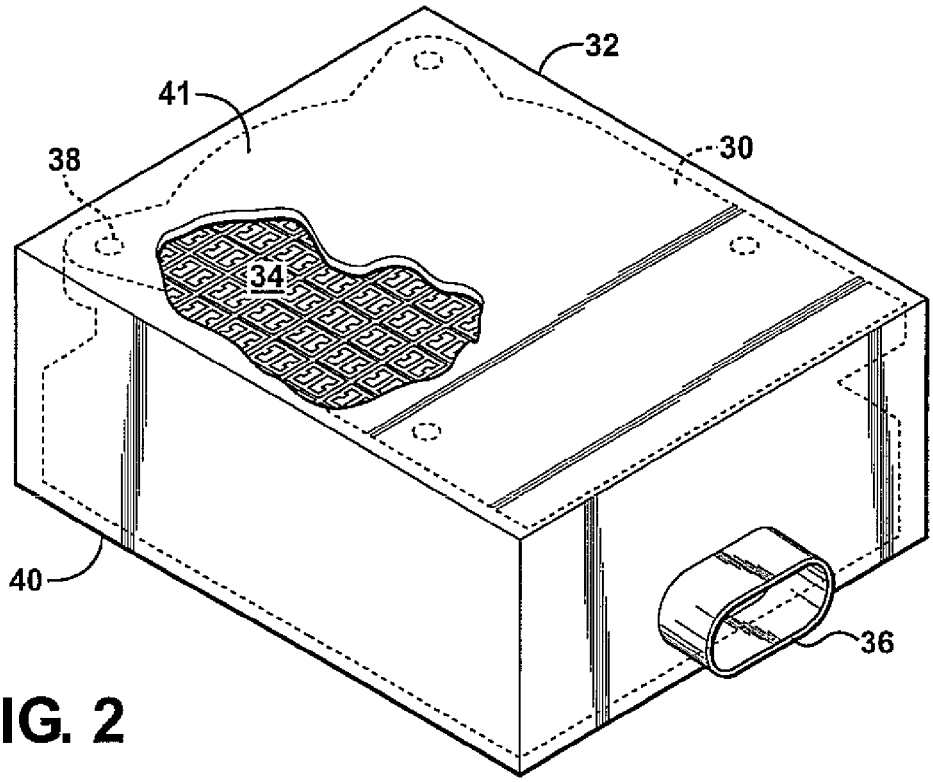
FIG. 2 shows an apparatus according to an embodiment of the present invention within a housing.

FIG. 2 shows an example apparatus comprising housing 32, lens assembly 30 having attachment holes 38, housing base 40, and a metamaterial lens 34 shown in a cutaway portion of the lens assembly. The housing further includes a protrusion 36, which may be used for mounting and which may be used to accommodate an electrical connection. The metamaterial lens 34 is a generally circular region of patterned conductors within the lens assembly 30. Only a portion of the metamaterial lens 34 is shown in this view, through the cutaway portion of an exterior surface of the lens assembly 41. The exterior surface 41 may comprise a protective layer, such as a plastic layer. The apparatus may be configured in cross-section similar to the arrangement shown in FIG. 1.

FIGS. 3-7 show further views of the example apparatus of FIG. 2.

Figure 3:
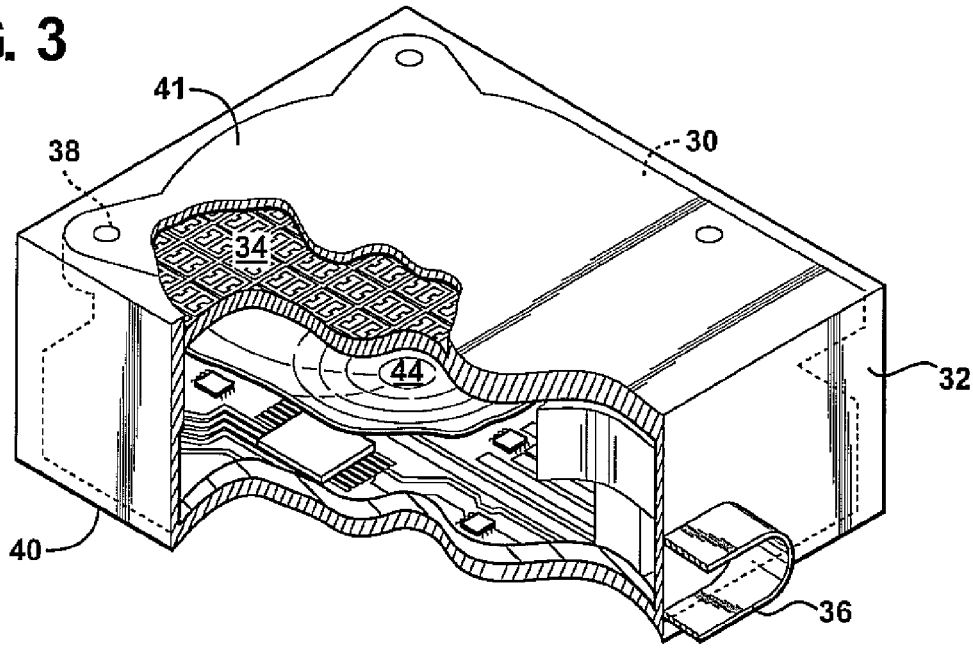
FIG. 3 shows a view of the example apparatus of FIG. 2, revealing a portion of the internal circuitry and reflector.

FIG. 3 is a cutaway view of the apparatus, showing lens assembly 30, housing 32, housing protrusion (shown in part) 36, housing base 40, circuit board 42, and reflector 44. The reflector 44 is a generally concave reflector, which may be a parabolic reflector, located underneath the metamaterial lens in the orientation of this figure. An antenna is disposed on the underside of the lens assembly 30, and transmits radiation towards the reflector 44. The radiation is then reflected back through the lens portion 34 of the lens assembly 30 and emerges out of the exterior surface 41 of the lens assembly.

Figure 4:
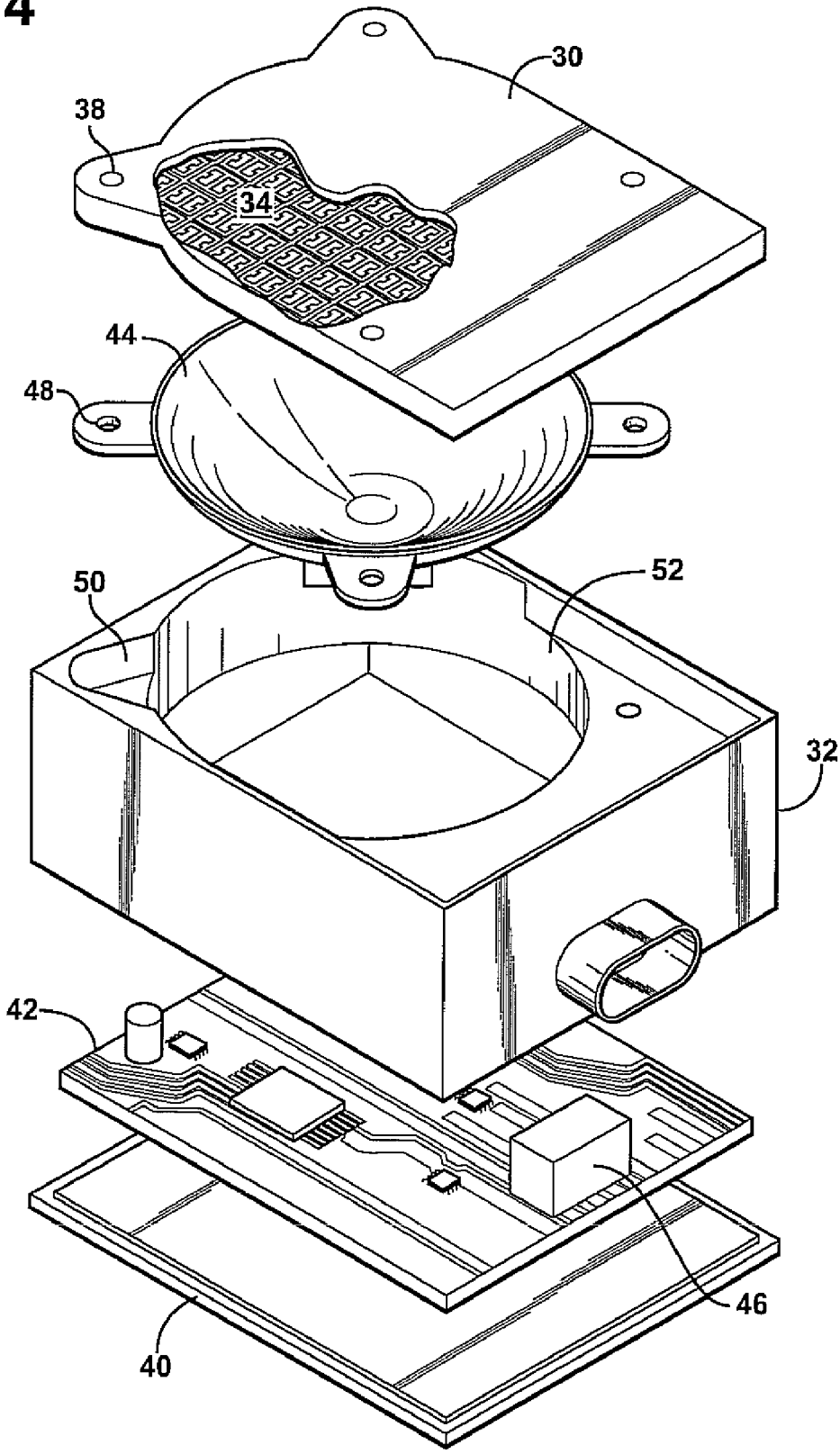
FIG. 4 is an exploded view showing arrangements of a metamaterial lens, reflector, and a support electronics circuit board.

FIG. 4 is an exploded view showing lens assembly 30, housing 32, metamaterial lens 34, reflector 44, circuit board 42, circuit component 46, and housing base 40. A fastener (such as a bolt, screw, or other fastener) can extend through lens assembly attachment hole 38, reflector attachment hole 48, and into a hole within a recess 50 configured to accept the reflector 44 and the lens assembly 30. The housing 32 has a generally circular recess opening 52 therein configured to receive the generally dish-shaped reflector 44. The circuit board 42 is used to provide power electronics, signal processing, and communications functionality. An RF electronic circuit is integrated into the lens assembly 30, along with a generally circular metamaterial lens shown in part at 34.

Figure 5:
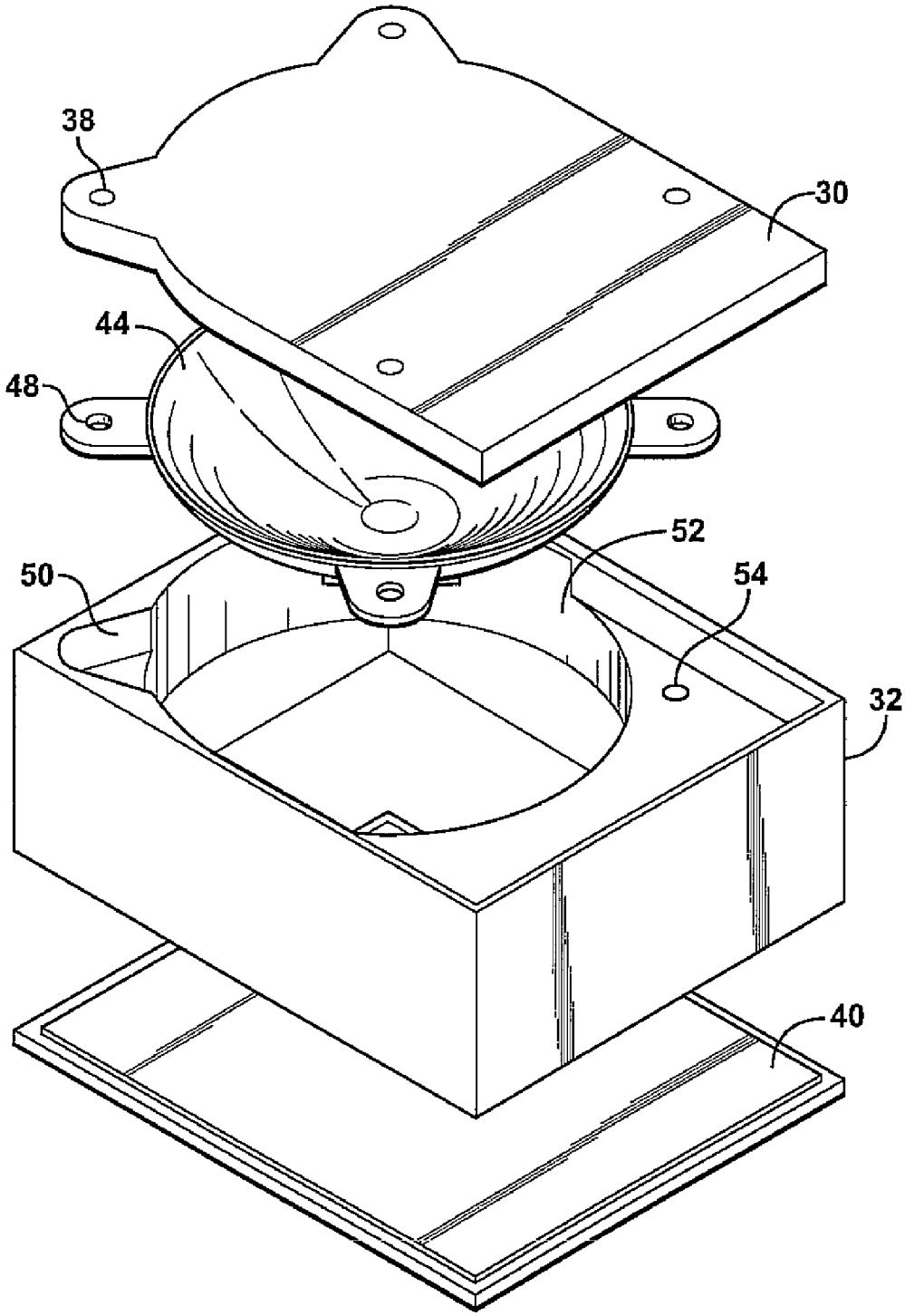
FIG. 5 is a simplified exploded view.

FIG. 5 is a simplified exploded view, showing lens assembly 30, reflector 36, housing 32, and housing base 40. This figure more clearly shows a plurality of holes in the lens assembly, such as attachment hole 38, corresponding to holes within protrusions from the reflector, such as attachment hole 48, and attachment receiving holes such as 54, allowing the lens assembly and reflector to be attached and secured within a recess within housing 32. The recess has a generally circular portion 52, shaped to receive the reflector, and additional portions 50 shaped to receive protrusions of the reflector and lens assembly having attachment holes therein.

Figure 6:
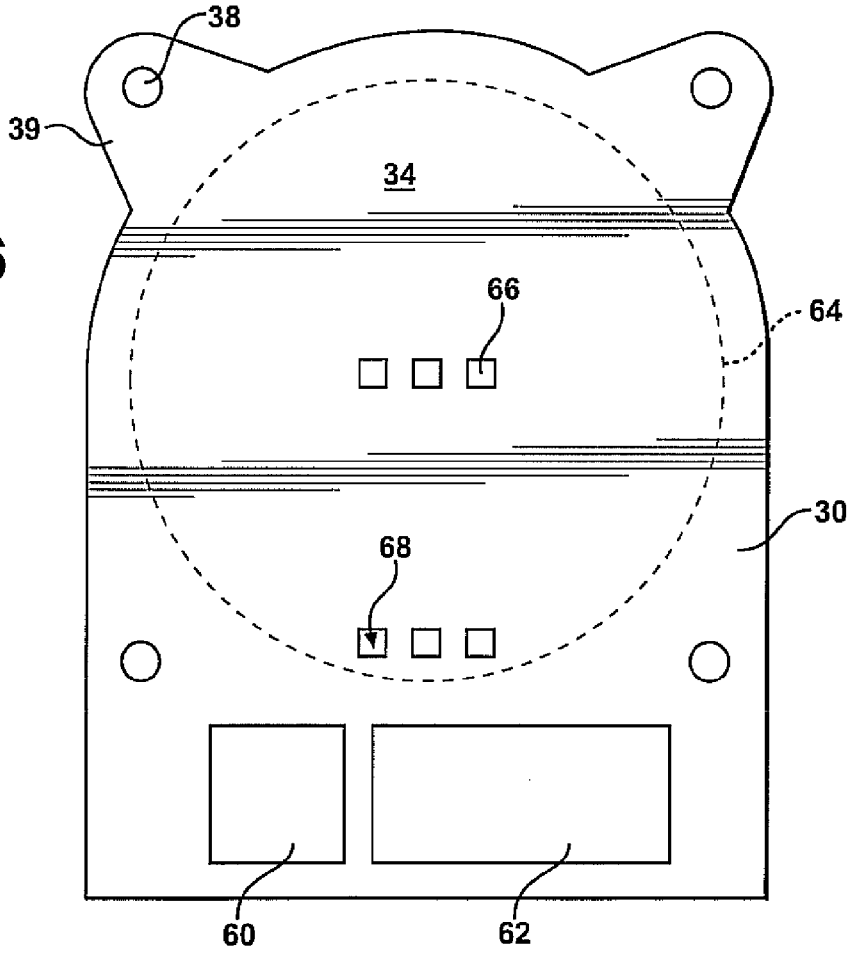
FIG. 6 shows a lens assembly comprising an integrated metamaterial lens and RF circuit, and further including a patch antenna feed.

FIG. 6 is a view of the underside of lens assembly 30, as shown in FIG. 5, showing attachment hole 38 within protrusion 39, and location of associated circuitry such as voltage control oscillator 60, and RF circuitry and down-conversion circuitry located generally at 62. The figure shows a dashed circle generally at 64, corresponding to a circular periphery of the metamaterial lens, so that the interior of this circular area corresponds to the location of patterned conducting elements of metamaterial lens 34. The figure also shows patch antenna feeds at 66. In other examples, the antenna feeds may be located elsewhere within the lens assembly, for example at edge feed locations at 68.

The lens assembly may be a unitary structure, for example a unitary structure including a multilayer circuit board. The lens assembly may be a generally planar structure, for example having a thickness of between about 1 mm and about 10 mm, more particularly between about 3 and 7 mm, and in this example about 5 mm.

Figure 7:
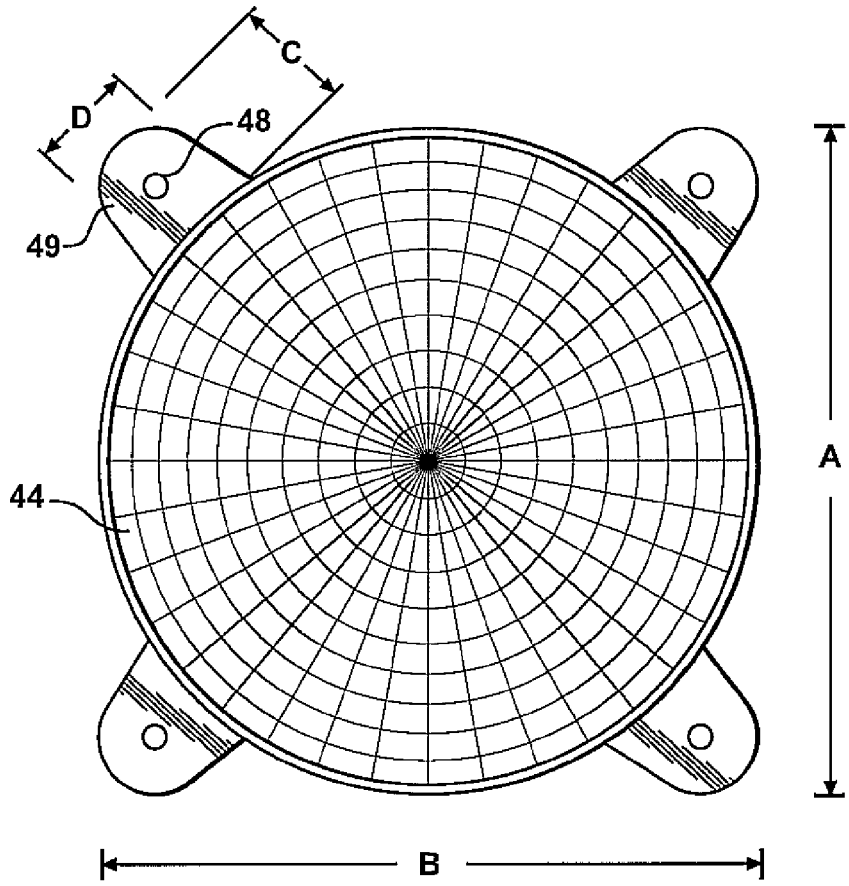
FIG. 7 shows a reflector.

FIG. 7 is a view of a reflector 44, showing protrusions 49 extending away from the generally circular reflector, having attachment holes therein (such as 48) through which the reflector may be secured to the housing. The holes in the reflector and the holes in the lens assembly (38) may be aligned and fasteners used to attach both to the housing.

An example apparatus was designed, as illustrated by FIGS. 3-7, in which the reflector was a parabolic reflector having a diameter of about 60 mm and a depth of about 16 mm. The housing has outside dimensions of approximately 79 mm×64 mm (the dimensions of the base), and a height of approximately 30 mm. The lens assembly is a generally planar structure, approximately 60 mm×75 mm, having a thickness of approximately 5 mm. An example lens assembly comprised a pair of double sided printed circuit boards.

The lens assembly may have a generally rectangular, circular, or other shaped periphery, or have an irregular periphery. In the example as discussed above in relation to FIG. 5, the lens assembly is generally rectangular, but has an irregular periphery accommodating the circular metamaterial lens and protrusions used for attachment to the housing.

A lens assembly may be a unitary structure, for example comprising one or more printed circuit boards. Advantages in manufacturing cost, reliability, and device alignment stability may be obtained by integrating the antenna onto the same circuit board (or other substrate) also used to provide a component of the metamaterial lens.

Figure 8:
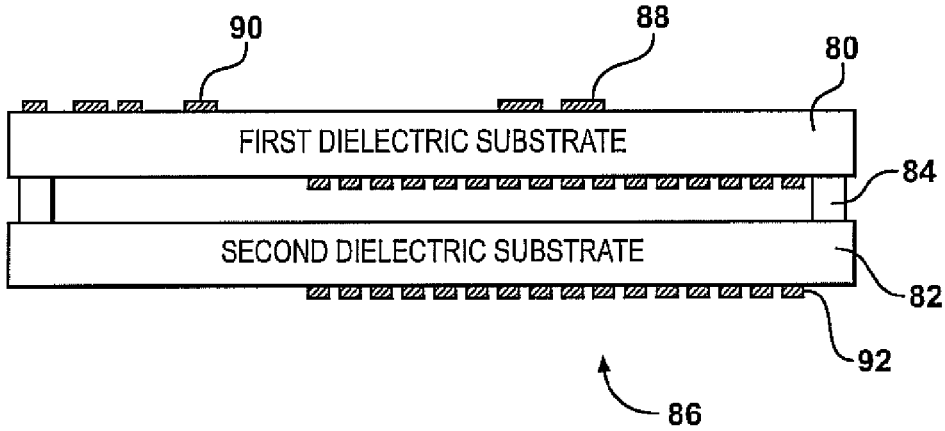
FIG. 8 shows a lens assembly comprising a multiple dielectric layers.

FIG. 8 shows a lens assembly comprising a multiple dielectric layers. The lens assembly comprises first dielectric substrate 80, spacer 84, and second dielectric substrate 82. In this example, the dielectric substrates are provided by printed circuit boards which have been etched to provide conducting patterns 92 in the metamaterial lens region 86 (in this example on both substrates), the antenna feed 88, and the circuit board configuration for the RF circuit at 90 (RF circuit components are not shown). This example is simplified and exemplary, and other configurations are possible. A single board device is possible. The metamaterial lens may be provided by an array of conductive patterns.

An example lens assembly may comprise one or more dielectric substrates, which may comprise a dielectric material such as a glass or plastic. In some examples, the substrate may be a liquid crystal polymer. Specific examples include liquid crystal polymers used in single or double clad laminate circuit boards, for example the Ultralam™ series (Rogers Corporation, Chandler, Ariz.), or other thermotropic aromatic liquid crystal polymer substrate. Two or more such boards may be used in a multilayer substrate of a lens assembly. For example, a pair of Ultralam™ 3850 double clad circuit boards may be stacked to form a multilayer structure, providing four conducting (copper) layers that may be etched or otherwise processed to obtain a metamaterial lens, antenna feeds, and a circuit board to support an electronic circuit. Vias may be provided through and between circuit boards, as required. The boards may be separated by spacers, for example spacing elements. A spacing element may comprise a fully etched circuit board, possibly in combination with bonding films such as Ultralam™ 3908 (Rogers Corporation, Chandler, Ariz.).

Circuit boards may be spaced apart by, for example, 25 to 500 microns, more particularly 75 to 150 microns, through the use of bonding films and/or etched circuit board substrates. The beam diameter and lens configuration may be chosen to obtain desired beam properties. An antenna assembly may be assembled layer by layer, for example using a plurality of printed circuit boards, including layers supporting a metamaterial lens, a ground plane layer, and a patch antenna layer.

Figure 9:
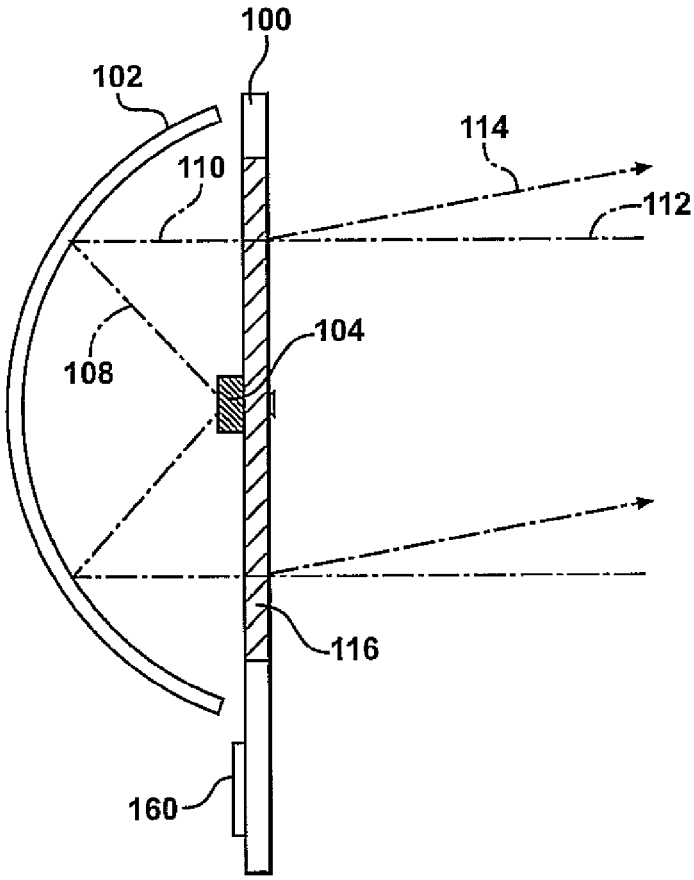
FIG. 9 shows another example configuration.

FIG. 9 shows a further example, comprising a metamaterial lens assembly 100, comprising a metamaterial lens within hashed area 116, reflector 102 spaced apart from the lens assembly, with patch antenna feed 104 and RF electronics 106 being integrated into the lens assembly 100. In this example, the antenna is operable to produce a transmitted beam 108, which propagates towards the reflector 102. The reflected beam 110 is generally parallel. In this example, the metamaterial lens has two modes, no index gradient (essentially no lens), and index gradient. In the first mode, the output beam 112 is not appreciably deflected by the lens. In the second mode, the index gradient produces an appreciable deflection of the output beam, shown at 114. This example is not limiting. There may be a plurality of operating modes, capable of producing deflections on either side of the lens normal (parallel to beam 112), and optionally in orthogonal or other planes. In other examples, the beam may be scanned continuously, or rastered over an angular range, or otherwise controlled as desired.

Figure 10A:
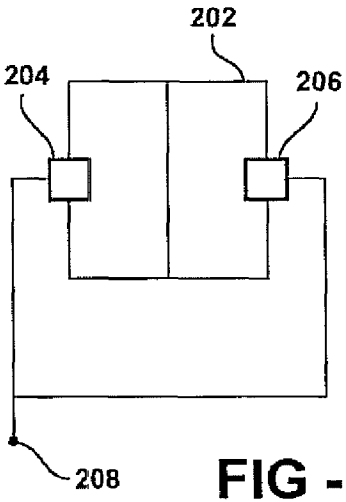
FIGS. 10A-10D illustrate use of a gradient index lens.

FIGS. 10A-D illustrates aspects of an example control system according to some embodiments of the present invention. FIG. 10A illustrates a conducting pattern, in this case a resonator, schematically at 202, comprising first and second tunable elements 204 and 206 respectively controlled using a control signal applied through control electrodes 208. One or both of the tunable elements may be adjustable capacitors, such as a varactor, or other tunable elements. The resonator is one of a plurality of resonators present within a layer of the metamaterial. For example, a voltage tunable dielectric may be provided within the capacitive gap of a split ring resonator. Other configurations are possible, such as other conducting pattern configurations and/or tunable elements.

Figure 10B:
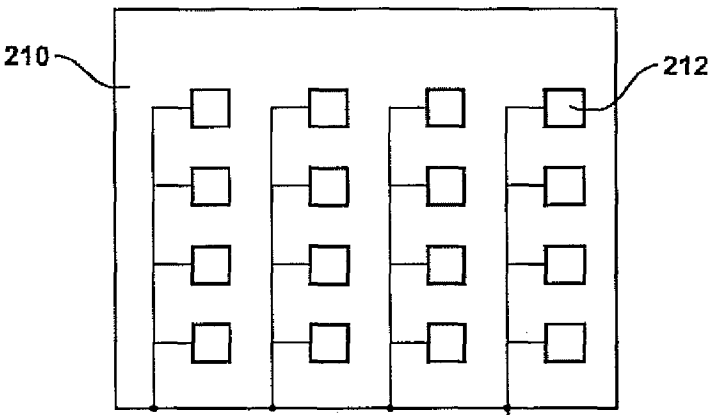

FIG. 10B shows a substrate 210 including a plurality of conducting patterns, each conducting pattern being represented by a box such as 212. This figure is not to scale, and a representative lens may have a large number of conducting patterns. For example, the unit cell dimension may be approximately square with an edge length of about 100 microns to 500 microns. This may form a single layer of a metamaterial, and further may comprise associated drive circuitry for applying bias voltages to tunable elements associated with each conducting pattern. Hence, an example metamaterial lens may include a plurality of tunable unit cells, so that, for example, application of a spatially varying bias voltage leads to a correlated spatial variation of index within the metamaterial. In this case, metamaterial index can be varied spatially by applying different potentials to each column of conducting patterns using electrodes 214.

Figure 10C:
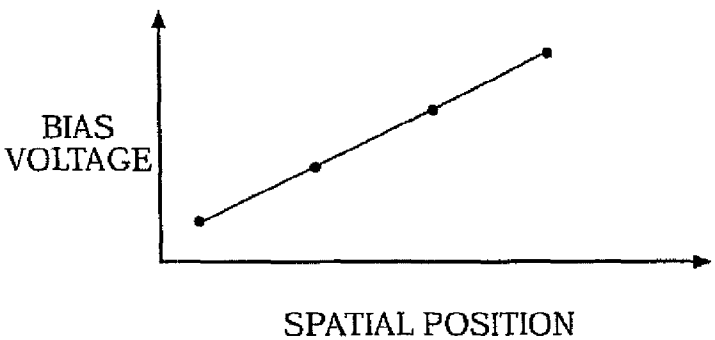

FIG. 10C shows schematically how index may vary with bias voltage. The variation may be linear or non-linear with spatial dimension, along one or two axes, or otherwise varied.

Figure 10D:
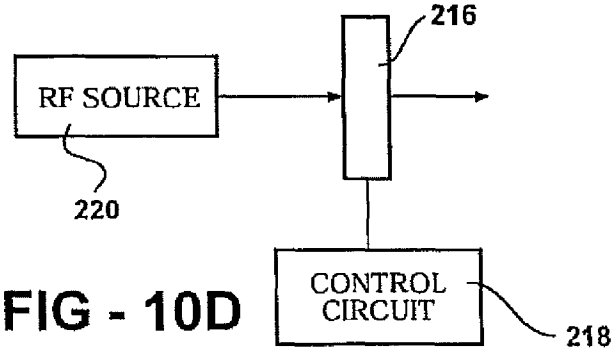

FIG. 10D shows a metamaterial lens 216 including one or more layers such as 210, with a control circuit 218 used to apply control signals to one or more of the layers. A radiation source 220, in this example representing the antenna and reflector that cooperatively provide a reflected beam incident on the metamaterial lens, provide radiation that passes through the metamaterial lens, and the beam properties of the output beam can be adjusted using the control circuit.

Figure 11:
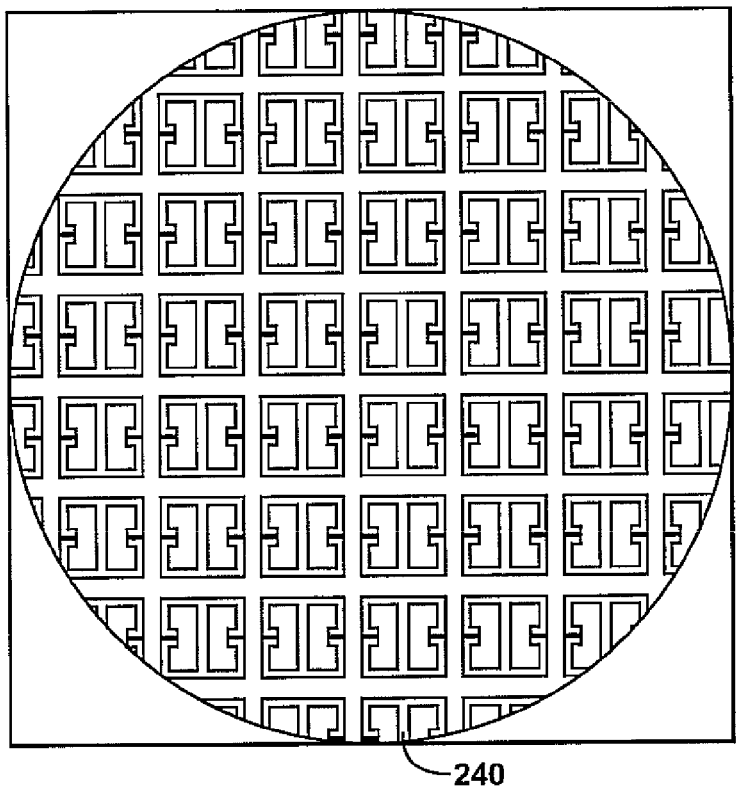
FIG. 11 shows a micrograph of a metamaterial.

FIG. 11 shows a micrograph of a metamaterial having a unit cell dimension of 500 microns. The resonance frequency was about 66 GHz. The metamaterial comprises a plurality of conducting patterns on a dielectric substrate, in this example Pyrex™ (Corning Incorporated, Corning, N.Y.) borosilicate glass. The conducting pattern was prepared using a photoresist-based method. In this example, the metamaterial is a passive metamaterial. Metamaterials having similar configurations, for example formed by modified printed circuit board processing techniques, may be used in embodiments of the present invention. Unit cell parameters may be adjusted through control of the spatial extent of the capacitive gap 240.

In specific examples of the present invention, beam steering may be achieved using a variable bias voltage applied across tunable elements within the metamaterial, so as to provide a variable index or gradient index lens. A gradient index lens may be used to modify the direction of the emergent beam, for example through variable beam refraction, and the beam may be scanned in one or more planes. Such a configuration is useful for automotive applications, for example adaptive cruise control, parking assistance, hazard recognition systems, and the like.

Applications of the present invention include automotive radar, such as automatic cruise controls, hazard detection, parking assistance, pedestrian detection, lane excursion warning devices, and the like. However, the invention is not limited to automotive radars and may be used in other applications such as communications, power transmission, radar reception, and the like.

For example, in other examples of the present invention a radar detector may be located at the location of the transmitter in the examples above. Such configurations may be used to provide a compact radar receiver.

In other examples, a transceiver may be used, allowing both transmission and reception to be obtained in a compact device. An improved radar transceiver comprises a metamaterial lens, a transceiver supported by the metamaterial lens, and a reflector. The reflector is positioned so as to direct transmitted radiation from transceiver through the metamaterial lens, and to direct radiation received through the metamaterial lens back to the transceiver.

Examples of the present invention are not limited to radar applications, and include apparatus and methods used within other electromagnetic bands such as IR or visible. For example, a laser may be used as an electromagnetic source, and an optical metamaterial used as a passive or dynamically tunable element.

A representative example of the present invention includes a concave reflector, an electromagnetic source such as a radar antenna, which may be located proximate the focus of the reflector, the electromagnetic source being supported by a metamaterial lens. Transmission from the electromagnetic source is focused by the reflector, and may form a generally parallel beam that passes through the metamaterial lens. The direction of the generally parallel beam may be controlled by the lens. For example, a gradient index lens may be used for beam steering, and a gradient index lens including an active metamaterial may be used as a dynamically controllable beam steering device.

In some examples, the antenna may be located proximate a focal point (or focus) of the reflector. The reflected beam obtained from the reflector may be diverging, substantially parallel, or converging as required. The degree of divergence or convergence, and/or the average direction of the beam may be further controlled by the metamaterial lens.

For example, the beam from the electromagnetic source may have an appreciable degree of divergence after reflection, and the lens may be used to obtain one or more of the following: convergence of the beam to form a generally parallel beam, adjustable convergence and/or divergence of the beam to obtain an adjustable field of view of the beam, and/or beam steering.

Metamaterials

Embodiments of the present invention include metamaterials having an electromagnetic property that may be dynamically adjusted using a control signal. The control signal may be an electrical control signal, for example using a variable electric field to adjust the permittivity of a tunable element within a metamaterial unit cell. A tunable element may be a varactor diode, or other element providing an electrically tunable capacitance.

A tunable element may comprise a tunable material, such as a ferroelectric or phase change material. A tunable material may have a voltage-tunable permittivity, so that the permittivity of the tunable material and hence the electromagnetic parameters (such as resonance frequency) can be adjusted using an electrical control signal. Examples include ferroelectric materials such as barium strontium titanate, and phase change materials such as chalcogenide phase change materials.

An example metamaterial comprises a plurality of unit cells, and may optionally include at least one unit cell including an electrically conducting pattern ("conducting pattern") and a tunable element, The conducting pattern and tunable element together provide a resonant circuit. The properties of the tunable element may be adjusted using a control signal to adjust the electromagnetic properties of the unit cell, such as resonance frequency, and hence of the metamaterial. Example conducting patterns include electrically-coupled LC resonators and the like.

An example metamaterial may further comprise a support medium, such as a substrate, such as a glass, plastic, ceramic, other dielectric, or other support medium. The support medium may be a dielectric substrate in the form of a sheet, such as a polymer substrate. In some examples, free-standing or otherwise supported wire forms may be used to obtain conducting patterns. A dielectric substrate may be a rigid planar form, may be flexible yet configured to be substantially planar, or in other examples may be flexible and/or curved.

In some examples, a unit cell includes a conducting pattern which may include one or more capacitive gaps. A capacitive gap may be formed as a physical separation between first and second segments of the conducting pattern. In some examples, the gap may be formed as a spacing apart of coplanar elements, for example printed conductors on a dielectric substrate in the manner of a printed circuit board. A tunable material may be located within a capacitive gap of a conducting pattern, and a control signal can applied to the tunable material so as to adjust one or more electrical or electromagnetic parameters, for example allowing gap capacitance to be dynamically adjusted. In other examples, some other field such as a magnetic field, electromagnetic radiation field such as a laser, or other field may be used to modify the properties of the tunable material.

Electrical control signals may be used to modify properties of an active metamaterial, and hence a lens comprising such an active metamaterial. For example, electrodes may be provided to allow application of control signals to tunable elements within an active metamaterial. These electrodes may include parts of the electrically conducting pattern used to form resonant circuits, or may be separate.

Metamaterials lenses according to examples of the present invention may be used for control of electromagnetic radiation. Example applications include lenses (including gradient index lenses), beam steering devices such as may be used in an automotive radar system, and the like.

In some modes of metamaterial operation, the operating frequency may be relatively close to the resonance frequency of component unit cells. An operating frequency close to resonance allows a suitably configured metamaterial to act as a negative material at the operating frequency, having negative permittivity and/or negative permeability. Lens properties using such negative materials may have less aberration than lenses formed from conventional positive materials.

However, a disadvantage of operating a metamaterial close to resonance frequencies is that resistive losses are increased. Hence, it may be preferable to operate at frequencies sufficiently separated in frequency from the resonance frequency so that substantial losses are avoided. For example, the metamaterial may be used as a positive material, having positive permittivity and/or positive permeability. Operational frequencies may be above or below a resonance frequency. In some examples, an operating frequency may be approximately $\leqq 0.8$ or $\geqq 1.2$ times the resonant frequency.

A metamaterial may have substantially uniform properties over its spatial extent, for example comprising a plurality of resonant circuits, each having a similar resonance frequency. In other examples, unit cell parameters, such as resonance frequency, may have a spatial variation over the surface of the metamaterial. For example, the index may vary in one or more directions. An active metamaterial may be used, a control signal being applied so as to obtain a desired spatial distribution of metamaterial index.

A gradient index metamaterial may be used to provide beam steering. Using a control signal, the index gradient may be dynamically varied, allowing beam scanning in one or more planes to be obtained.

Micro-fabrication techniques may be used for fabrication of metamaterials. For example, conventional printed circuit techniques may be used to print a conducting pattern on a substrate, for example a printed circuit board.

The substrate material is not limited to polymers such as plastics, and the substrate may also comprise glass, ceramic, or other dielectric material. Typically, the conductivity of the dielectric may be three or more magnitudes less than the conductivity of the conducting pattern under an operating condition, and may be many orders of magnitude less, such as $10^{-5}$ or less.

Metamaterial Lenses

A metamaterial lens may be provided by a metamaterial having a spatial variation of index over the spatial extent of the lens, for example as gradient index lenses. The index gradient may be generally linear. Example gradient index lenses are described in WO2006/023195 to Smith et al. However, embodiments of the present invention are not limited to negative metamaterial lenses.

A metamaterial may comprise a repeated unit cell structure. An example unit cell comprises an electrically conducting pattern formed on an electrically non-conducting (dielectric) substrate, the electrically conducting pattern providing an electrically-coupled inductor-capacitor (ELC) resonator, for example a split ring resonator.

In some examples, resonators formed on a substrate have a parameter (such as resonant frequency) that has a spatial variation. The permittivity and permeability of the metamaterial to an incident electromagnetic wave can hence be varied as a function of spatial position, allowing index profiles (such as gradient index profiles, parabolic index profiles, and the like) to be obtained.

Applications

Integrated metamaterial lenses may be used for beam steering of electromagnetic beams and/or adjustable focus applications. Applications include radar devices and other radio frequency applications. However, examples may include apparatus and methods operating at terahertz, IR, near-IR, visible, and other electromagnetic wavelengths.

An example application is beam steering for radar applications, for example an automotive radar. The operating frequency may be approximately 77 gigahertz, or other suitable frequency. The index profile (spatial variation of index across the metamaterial) at an operating frequency may be designed as required, and for an active metamaterial may be dynamically adjusted.

The operating frequency of a radar device may be within typical designated public operating frequencies for radar or similar resonator devices. A particular example application is controlled beam steering for radar applications. The operating frequency may be approximately 77 gigahertz or have a wide bandwidth about 79 gigahertz, or other suitable frequency. In such an application, the resonant frequency of any particular resonator may be selected to be somewhat less than the operational frequency, for example in the range of 40 to 70 gigahertz, so that the metamaterial acts as a positive index material at the operating frequency.

Active metamaterials allow beam steering using a low frequency control signal. For example, a beam can be formed using a reflector and a lens in combination, and the beam can be steered by actively changing an index gradient in the metamaterial lens. This approach reduces the complexity and cost of RF electronics when compared with conventional approaches. Higher reliability and faster responses are obtainable compared with a mechanically steered system.

Applications further include radar guns, such as K-band (18-27 GHz) devices. Embodiments of the present invention include compact apparatus for determination of distance and/or speed of remote objects. Example apparatus may have a length (in the direction of radar beam output) of less than 100 mm, in some examples less than 50 mm, allowing convenient carrying.

Example applications include radar apparatus having operational frequencies within a range of between about 3 MHz and about 300 GHz, in particular between 1 GHz and 300 GHz (e.g. microwave apparatus), and more particularly between 1 GHz and 110 GHz (e.g. L band through W band). Example ranges are inclusive.

Another application is collision avoidance radar for an automobile. Further, by adjusting beam properties, multifunctional devices may be obtained, for example combining collision detection, parking assistance, and/or automatic cruise control functionalities into a single device. The function may be user-selectable from a plurality of such functions, or the function may be selected using an electronic circuit. For example, highway driving may allow collision avoidance function to be selected (manually or automatically), and adaptive cruise control assistance to if cruise control is selected. Low speed maneuvering may allow parking assistance function to be selected.

Other applications include switchable devices for example having a plurality of operating modes. Active scanning of a radar beam is possible in one or more planes using an active metamaterial. An apparatus may include a plurality of reflectors, each having an associated antenna, for example an array of reflectors and associated antennas.

Embodiments of the present invention include an automotive radar apparatus comprising a dish reflector (having a concave reflecting surface, such as a parabolic reflector) and a metamaterial lens. In some examples, the radar apparatus comprises a planar metamaterial gradient index lens integrated with an RF electronics circuit, spaced apart from a reflector. The metamaterial lens may further include a patch antenna feed and RF electronics, providing an antenna which is integrated into a circuit board. A lens assembly may comprise an RF electronic circuit integrated with a metamaterial lens and an antenna in a unitary structure.

Embodiments of the present invention include an automotive radar apparatus using a dish reflector coupled with a metamaterial lens, the metamaterial lens being integrated with RF electronics. The apparatus may include electronic circuitry for signal processing, driving the antenna, signal reception, communication, direction and distance determination from radar signals, and the like.

Examples include a lens and a dish reflector configured for improved beam formation, beam steering, and apparatus compactness. A planar metamaterial gradient index lens can be used, which can be positive or negative refractive index, can be a single layer or multilayer metamaterial lens, and can be active or passive metamaterial. The RF electronics and the antenna may be integrated with the lens in a single RF board, giving a novel lens assembly that can provide cost benefits and improved reliability as an integrated assembly. RF electronics may include SiGe based circuits.

The invention is not restricted to the illustrative examples described above. Examples are not intended as limitations on the scope of the invention. Methods, apparatus, compositions, and the like described herein are exemplary and not intended as limitations on the scope of the invention. Changes therein and other uses will occur to those skilled in the art. The scope of the invention is defined by the scope of the claims.

Having described our invention, we claim:

1. An apparatus, comprising:
an antenna;
a metamaterial lens; and
a reflector,
the antenna being located proximate the metamaterial lens, the antenna being configured so as to generate radiation when the antenna is energized,
the reflector being positioned so as to receive radiation from the antenna, and to reflect the radiation through the metamaterial lens so as to provide output radiation.

2. The apparatus of claim 1, the reflector having a generally concave reflective surface.

3. The apparatus of claim 2, the reflector being generally parabolic.

4. The apparatus of claim 3, the reflector having a focal point, the antenna being located proximate the focal point.

5. The apparatus of claim 1, the metamaterial lens and the antenna being integrated into a lens assembly, the lens assembly being a unitary structure.

6. The apparatus of claim 5, the lens assembly further including a radio-frequency front-end electronic circuit in electrical communication with the antenna.

7. The apparatus of claim 5, the antenna being formed on a dielectric substrate, the dielectric substrate also being a component of the metamaterial lens.

8. The apparatus of claim 1, the metamaterial lens being a gradient index metamaterial lens.

9. An apparatus, comprising:
a metamaterial lens assembly, including a metamaterial lens;
an antenna, the antenna being a radar antenna; and
a reflector,
the metamaterial lens comprising a plurality of resonant circuits disposed on a dielectric substrate,
the metamaterial lens assembly supporting the antenna,
the reflector being positioned so as to reflect radiation from the antenna through the metamaterial lens.

10. The apparatus of claim 9, the reflector having a generally concave reflective surface.

11. The apparatus of claim 9, the metamaterial lens comprising a plurality of conducting patterns disposed on the dielectric substrate,
the dielectric substrate further supporting a radio-frequency electronic circuit associated with the antenna.

12. The apparatus of claim 11, the radio-frequency electronic circuit being in electrical communication with the antenna.

13. The apparatus of claim 9, the antenna being disposed on the dielectric substrate.

14. An apparatus, comprising:
a metamaterial lens assembly, including a metamaterial lens comprising a plurality of conducting elements disposed on a dielectric substrate;
an antenna, the antenna being a radar antenna supported by the metamaterial lens assembly; and a reflector, the reflector having a generally concave reflecting surface, the reflector being positioned so as to reflect radiation from generated by the antenna through the metamaterial lens.

15. The apparatus of claim 14, the metamaterial lens comprising an active metamaterial.

16. The apparatus of claim 15, an output beam divergence being controllable using an electronic control signal applied to the active metamaterial.

17. The apparatus of claim 15, an output beam direction being controllable using an electronic control signal applied to the active metamaterial.

18. The apparatus of claim 14, wherein the metamaterial lens is a gradient index metamaterial lens.

19. The apparatus of claim 14, the antenna being located proximate a focal point of the reflector.

20. The apparatus of claim 14, the metamaterial lens and antenna being integrated into a unitary structure.

21. The apparatus of claim 20, the unitary structure further including radio-frequency electronic circuit in electrical communication with the antenna.

22. The apparatus of claim 20, the unitary structure including a multilayer circuit board.

23. The apparatus of claim 20, the unitary structure being a generally planar structure, having a thickness of between about 1 mm and about 10 mm.

* * * * *